US009278257B2

(12) United States Patent
Kacar

(10) Patent No.: US 9,278,257 B2
(45) Date of Patent: Mar. 8, 2016

(54) SWIM AID FLOTATION DEVICE

(71) Applicant: David J. Kacar, Dunkirk, MD (US)

(72) Inventor: David J. Kacar, Dunkirk, MD (US)

( * ) Notice: Subject to any disclaimer, the term of this patent is extended or adjusted under 35 U.S.C. 154(b) by 0 days.

(21) Appl. No.: 14/289,245

(22) Filed: May 28, 2014

(65) Prior Publication Data

US 2015/0343267 A1 Dec. 3, 2015

(51) Int. Cl.
*A63B 31/00* (2006.01)

(52) U.S. Cl.
CPC ..... *A63B 31/00* (2013.01)

(58) Field of Classification Search
CPC ..... A61H 37/005; A47C 15/006; A63B 31/00
See application file for complete search history.

(56) References Cited

U.S. PATENT DOCUMENTS 3,183,530 A * 5/1965 Girden ..... 441/65
4,362,518 A 12/1982 Boissiere
4,379,704 A 4/1983 Rademacher
4,929,205 A 5/1990 Jones
5,833,505 A 11/1998 Huang
6,083,067 A 7/2000 McCredie
6,692,322 B1 2/2004 Heatherly
6,793,549 B1 9/2004 Chiang
6,872,111 B2 3/2005 Katz et al.
7,169,000 B1 1/2007 Hernandez et al.
2008/0081526 A1 * 4/2008 Hagedorn ..... 441/129

* cited by examiner

*Primary Examiner* — Edwin Swinehart
(74) *Attorney, Agent, or Firm* — Michael J. Foycik, Jr.

(57) ABSTRACT

A swim aid flotation device for supplementing the buoyancy of a swimmer's lower body torso and legs while allowing the swimmer the ability to kick their legs includes a unitary or two part foam member generally in the form of an inverted T-shape with the horizontal part of the T-shape connected to the vertical part of the T-shape. The vertical portion has an expanded top portion and keeps the device positioned between the legs while the horizontal portion straddles the legs. A flexible woven strap connects the device with a loop around the swimmer's body at the waist keeping the device positioned in the crotch area of the swimmer. This provides sufficient buoyancy without need for squeezing the legs together, maintains the swimmer's body in a more horizontal swim position and allows scissor leg kicks or other types of leg kicking motion.

16 Claims, 11 Drawing Sheets

SWIM AID FLOTATION DEVICE

CROSS REFERENCE TO RELATED APPLICATIONS

Not applicable.

STATEMENT REGARDING FEDERALLY SPONSORED RESEARCH OR DEVELOPMENT

Not applicable.

FIELD OF THE INVENTION

The present invention relates generally to swimming aids, and more particularly a flotation device for supplementing the buoyancy of a swimmer while allowing leg scissor kicking and other leg kicking motions.

BACKGROUND OF THE INVENTION

There are a number of swim aid flotation devices on the market generally known as pull buoys. AH of these current devices supplement flotation of the swimmer's body and generally immobilize the legs while allowing development of the arm portion of the swim stroke. The most commercially common of these are the pull buoys related to U.S. Pat. No. 4,379,704, and other buoy products that generally have a top flotation cylinder and bottom flotation cylinder connected by cords or straps. Similar swim aids are shown in U.S. Pat. Nos. 6,793,549 and 4,929,205, and have air/water buoyancy adjustment features.

Other swim aids are shown in U.S. Pat. Nos. 6,083,067 and 4,362,518, and are comprised of a single unit form with a joining section of reduced thickness that is in the shape of and doubles as a kick board.

All of these current devices require the squeezing of the swimmer's legs to hold the devices in place, thus mostly immobilizing the legs and prevent scissor leg kicking motion. This is a significant disadvantage of the aforementioned prior art devices.

The flotation device shown in U.S. Pat. No. 6,692,322 allows scissor leg kicking motion, however ft has a "U" shaped configuration that clamps to the swimmer's mid-torso and is connected by a fixed damping bar type member, and is generally designed for kicking in place while the swimmer's body is floating in a vertical position or connected to a fixed cord. There is a swim aid training device shown in now U.S. Pat. No. 7,169,000 that is generally in a rotated and one piece H shape that provides flotation by attaching to the lower calf area of a swimmer's legs thus immobilizing the swimmer's legs and preventing a scissor kicking motion.

A multi-purpose float is shown in U.S. Pat. No. 5,833,505, which has a kick board type device with a turning bar that straddles the legs, but does not hold the device on the swimmer thus requiring the squeezing and immobilization of the legs for kicking. Finally, there are other flotation devices on the market that attach by wrapping around the individual legs or lower torso of the swimmer allowing free motion of the legs, but are unrelated to the improvements provided by the present invention.

Generally, the prior art concentrates on providing buoyancy to the swimmer while immobilizing the swimmer's legs so that the swimmer can concentrate on developing the arm stroke. None of the prior art pull buoys allows for the alternating scissor kicking motion of the legs while wearing the invention in the preferred upper leg position.

SUMMARY OF THE INVENTION

From the foregoing, it is seen that it is a problem in the art to provide a device meeting the above requirements. According to the present invention, a device is provided which meets the aforementioned requirements and needs in the prior art. Specifically, the device according to the present invention is directed to swimming aids, and more particularly to a flotation device for supplementing the buoyancy of a swimmer while allowing leg scissor kicking and other leg kicking motions.

More specifically, the invention relates to a lower body torso and leg buoy to help level the swimmer's body in the water to facilitate ease of swimming various swim strokes. The present invention makes significant improvements over the prior art by allowing the movement of the swimmer's legs while swimming with a leg scissor kick or other leg motions of the various swim strokes.

The swim aid flotation device comprises a unitary or two part foam member generally in the shape of an inverted T-shape with the horizontal member of the T-shape connected to the vertical portion of the T-shape. The flotation device, whether formed as a unitary member as a two part member, is generally intended to be positioned just below the swimmer's crotch to provide flotation for the legs and swimmer's torso. A flexible, woven and water resistant strap connects the device with a loop around the swimmer's body at the waist keeping the device on the swimmer without the need for squeezing the legs. The device is intended to be adjustable and may be of various' sizes to fit various swimmer body types and weights and is intended to be durable and easy to put on and take off.

The swim aid flotation device may be a unitary member whereby the T-shape is formed by a single foam member thus minimizing the fabrication costs. Alternately the device may be fabricated as two foam members with a compression interlocking connection.

The swim aid flotation device may be used as a kick board with or without the vertical portion of the T-shape when not secured to the swimmers body.

In the preferred embodiment, the device member(s) take the shape of an inverted T with the horizontal member of the T taking the shape of an oval kick board and the vertical member of the device resembling a thin swim buoy. The flotation device may be constructed as a unitary or two-part member(s) that are made of resilient and buoyant material while the strap is made up of woven synthetic and water resistant fabric.

Other objects and advantages of the present invention will be more readily apparent from the following detailed description when read in conjunction with the accompanying drawings.

DETAILED DESCRIPTION OF THE INVENTION

Figure 1:
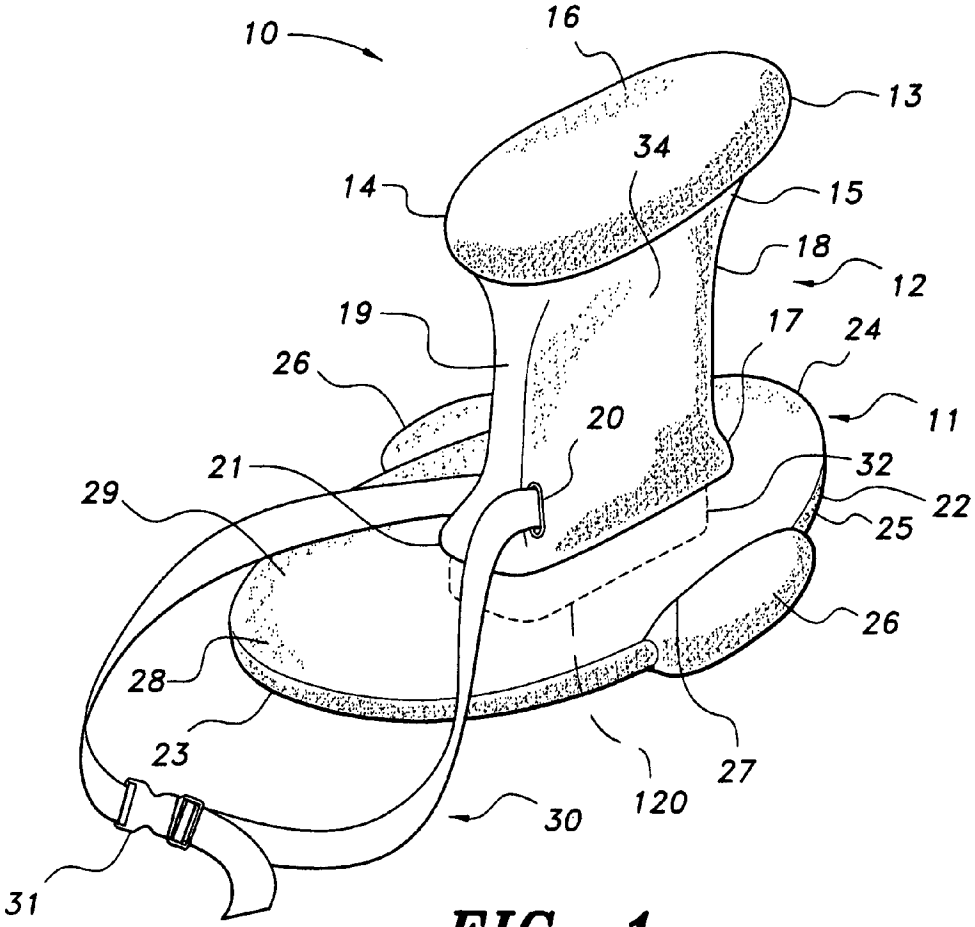
FIG. 1 is an isometric view of a swim aid flotation device embodying the concepts of the present invention.

FIG. 1 is an isometric view of a swim aid flotation device 10 embodying the concepts of the present invention. The device 10 is composed of a first portion 11 which is generally elliptical in shape and a second portion 12 which is in the form of an inverted T shape when disposed atop the first portion 11. The first portion 11 will also be referred to hereunder as a generally elliptical shaped member 11. The first portion 11 and the second portion 12 can be formed as a single unitary member, or the portions 11 and 12 can be formed as two separate members that are then joined together.

In a preferred embodiment, the first and second portions 11 and 12 are composed of a material that floats in water, and a preferred material for the portions 11 and 12 is foam. It is contemplated that other materials can be used in place of, or in addition to, foam, and ail such materials are encompassed herein that would be known to any one having skill in the aquatic flotation device arts.

In the preferred embodiment the first and second portions 11 and 12 are solid bodies that can be formed by molding processes; however other forming methods and constructions are contemplated as being within the scope of the present invention, and the first and second portions 11 and 12 can for example be solid, hollow, layered, and/or composite in construction, and can be formed by molding, cutting, machining, 3d printing, or by any other forming methods that would be known to any one having skill in the aquatic flotation device arts.

Figure 2:
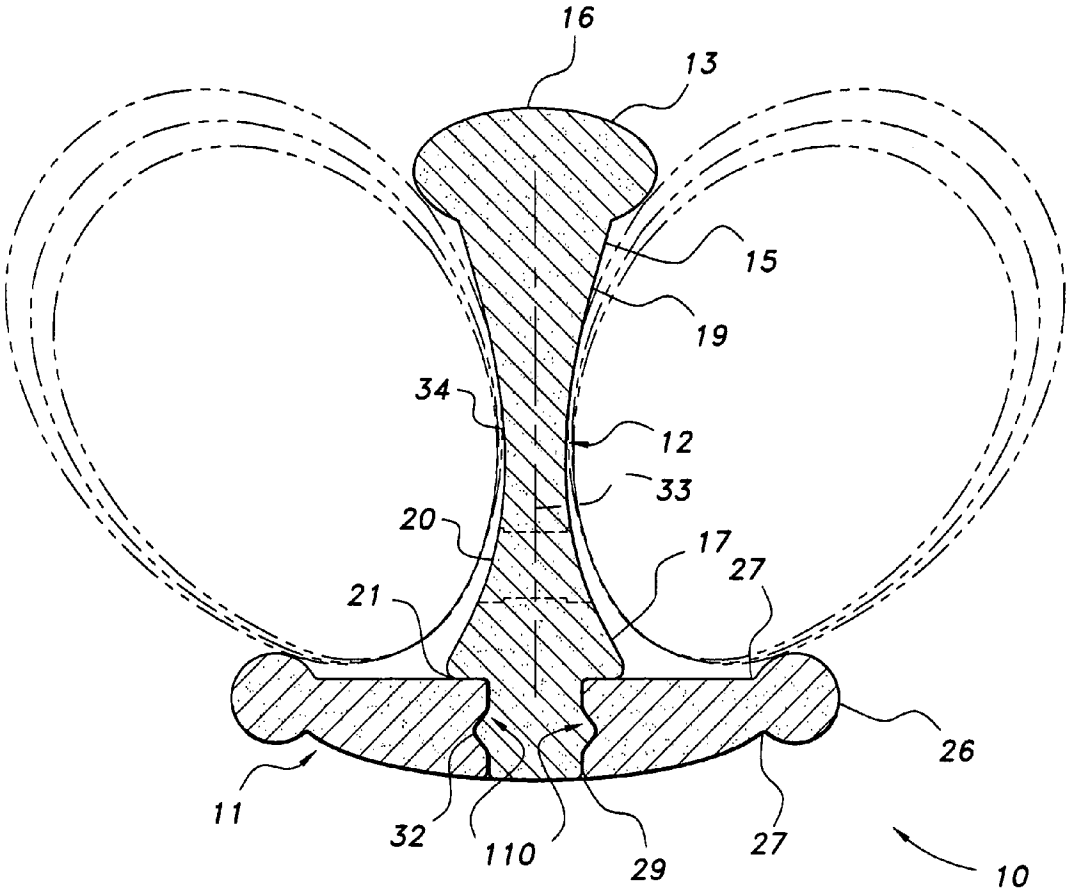
FIG. 2 is a transverse cross section view of the invention of FIG. 1.

In use, the device 10 generally takes the form of an inverted T shape when worn b a swimmer. A horizontal portion of the T is formed by the generally elliptical shaped portion 11, formed with or connected to the second portion 12. The second portion 12 has the appearance of a vertical stem, and is therefore also referred to hereunder as a vertical stem 12 or vertical member 12. The vertical stem 12 as seen in FIGS. 1 and 2 has an prolate top 13.

The vertical stem 12 has a slot 20 formed therethrough for receiving and attaching a flexible strap 30. Alternate attachment points of the strap 30 on the device 10 may be used without departing from the scope of the present invention. For convention, the swim aid device 10 will be described herein with the T in the inverted position, or the position as worn by the swimmer with the horizontal portion of the T positioned on the bottom and the vertical portion of the T extending upward from the horizontal, bottom member that corresponds to the generally elliptical shaped member 11.

Figure 3:
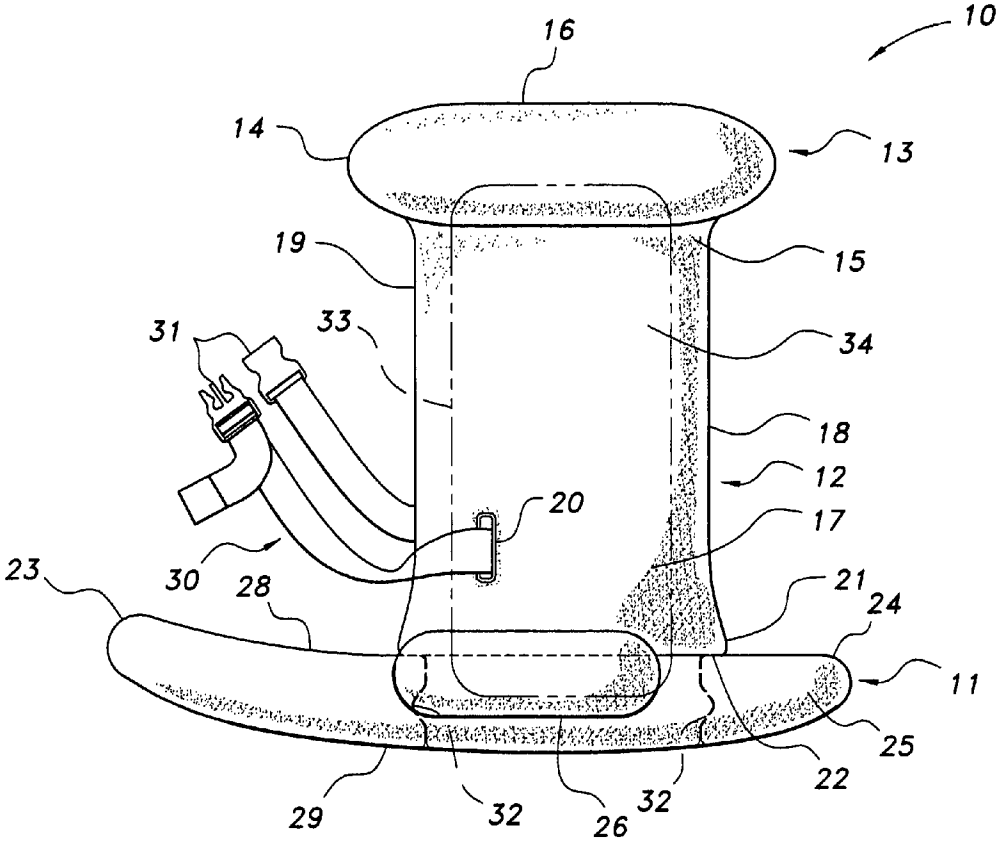
FIG. 3 is a side elevational view of the invention of FIG. 1.
Figure 4:
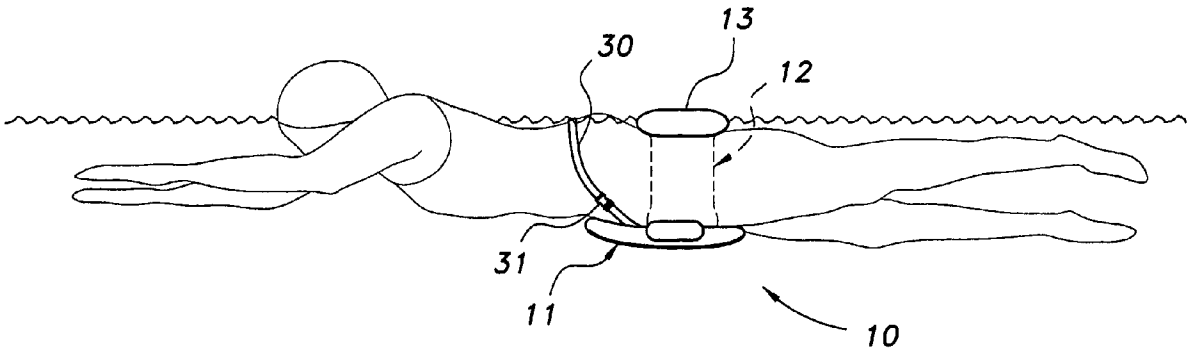
FIG. 4 is a side view of the invention of FIG. 1 as worn by a swimmer that is swimming on the breast.
Figure 5:
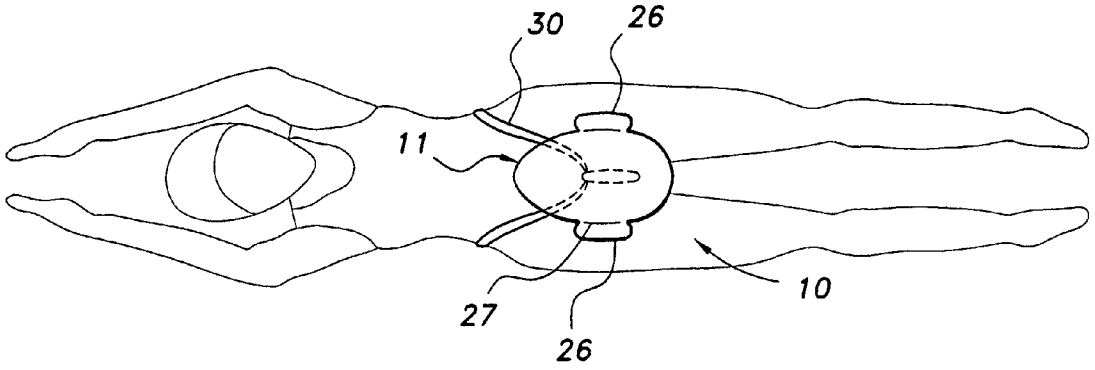
FIG. 5 is a bottom view of the invention as worn by a swimmer that is swimming on the breast.
Figure 6:
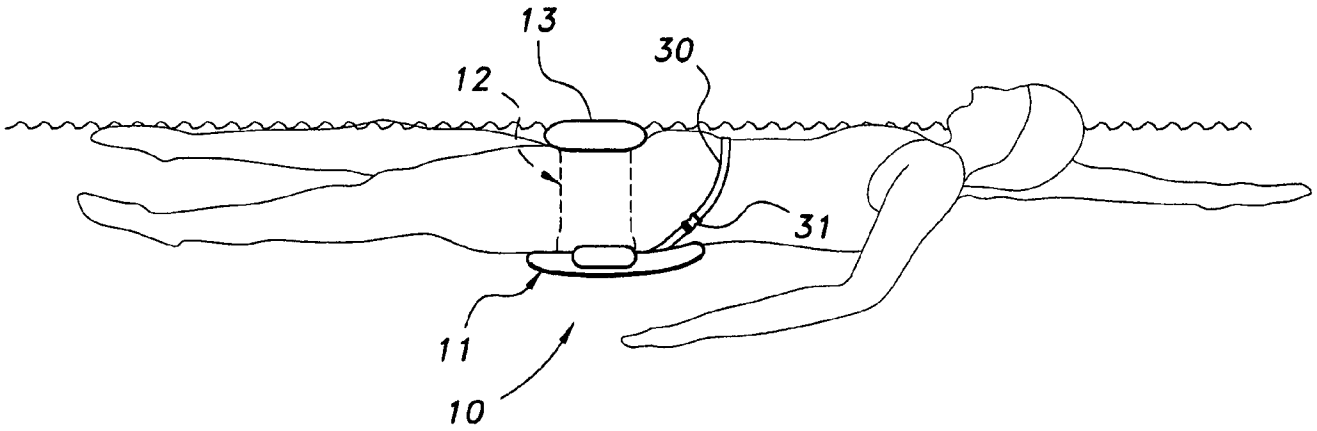
FIG. 6 is a side view of the invention as worn by a swimmer that is swimming on the back.

The generally elliptical shaped member 11 has an arching lower surface 25 that is tapered toward a lop, rounded edge 22, a rounded and shorter rear section 24 (seen for example in FIG. 3), and a pointier and longer front section 23. The member 11 has a body which is formed by a generally oblate half cross section 29 with the curving portion on the bottom and has a continuous cumin g surface with an arching surface 25. The half oblate cross section 29 curves up to a frontal portion 28 forming a less than 90 degree angle to the vertical portion of the T-shape that aids in keeping the member 11 against the swimmer's body with the flow of water while swimming. Opposed sides of the member 11 that are parallel to the member 12 have respective, generally prolate shaped accentuated members 26 that protrude up, down and out and have an inset crease 27 to provide hand gripping handles and friction points against the surface of the swimmer's legs. As discussed above the horizontal member 11 is a unitary formation with the vertical member 12, or can be constructed as two separate members, namely portions 11 and 12, with a compression, interlocking or other suitable connection 32.

The vertical member 12 has a substantially rectangular cross section with the horizontal length and height of a common pull buoy, but with a much thinner and flatter cross section shown by portion 34. The vertical member 12 has tapered and rounded edges 1 in the rear and 19 in the front, with flared cross sections 17 at the bottom and 15 at the top forming a continuous, curving transition to the bottom member 11 and to the top 13 of the vertical member 12. The top 13 has a prolate shape that is a unitary formation with the vertical member 12 and has continuously curving edges 14 and top 16. The top 16 is relatively enlarged. The second portion 12 can be seen as extending from a central region of the first portion 11, second portion 12 having the enlarged top portion 16 at an end of the second portion 12 that is distal from the first portion 11.

The prolate top 13 is larger than the cross section of the vertical member 11, and provides additional flotation buoyancy and aids in the positioning of the device on the swimmers legs and crotch. The member 12 has a continuous curving connection between the members 11 and 13. The vertical member 12 and top 13 may be a unitary formation with the horizontal member 11 or may be constructed as a separate member with a compression, interlocking connection 32 securing the members 12 and 13 with the member 11. The member 12 has sufficient reinforcement 33 in order for it to maintain its form, structural integrity and shape. The member 12 has the slot 20 toward the bottom and front that has a vertical shape and is sufficiently reinforced for the looping of the flexible strap 30 therethrough. A lowermost leading edge 21 of the member 12 is shown at the location where the member 12 meets the uppermost surface of the member 11. The member 12 has a lower projecting portion 120 that extends through an aperture 110 formed through the member 11.

The strap member 30 is preferably made from flexible, woven and water resistant fabric, and loops through the slot 20 on the vertical member 12 and around the waist of the swimmer. The strap member 30 has a standard fastening and strap adjusting device 31 on the ends thereof to customize the length of the strap for various swimmer body types and tightening the flotation device 10 on the body of the swimmer.

Figure 7:
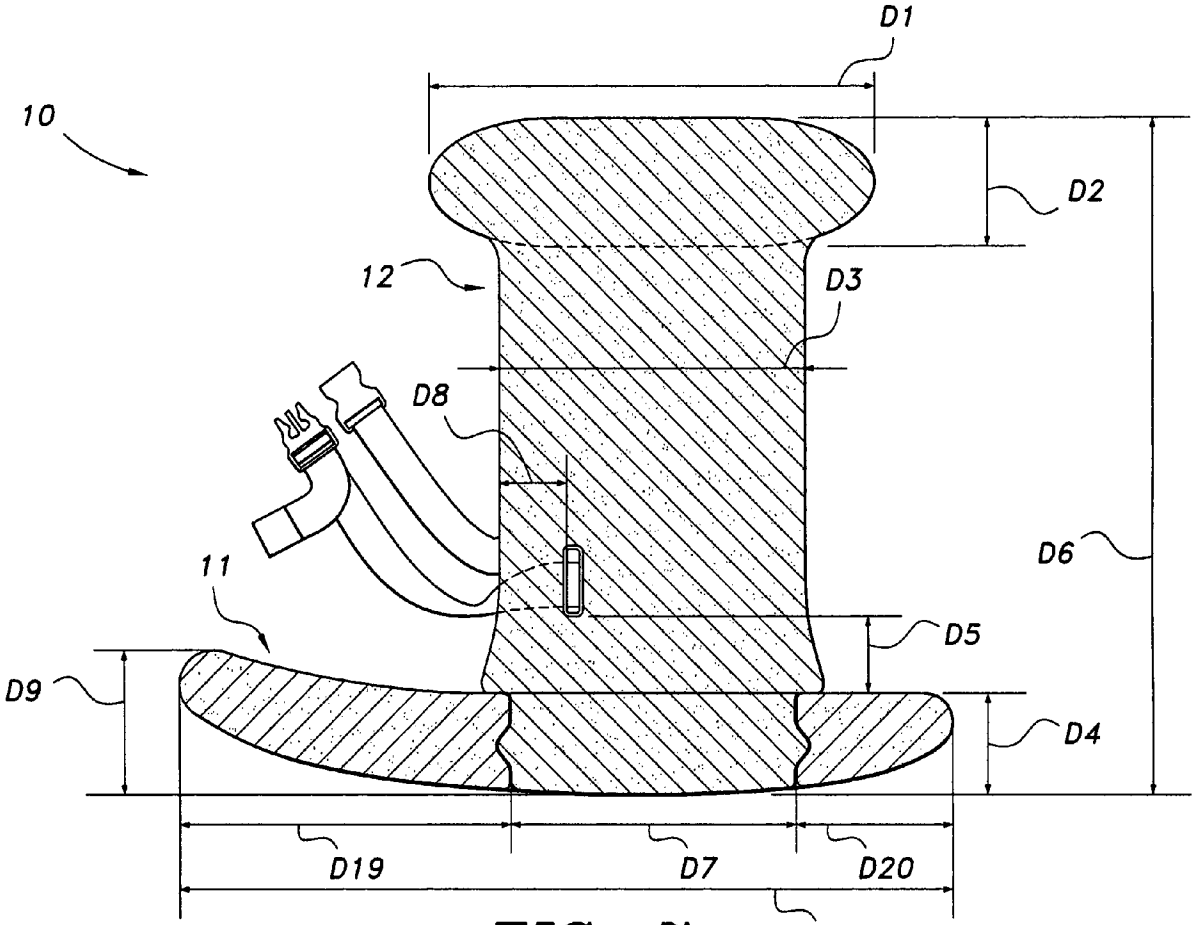
FIG. 7 is a longitudinal cross section view of the invention of FIG. 1.

FIG. 7 is a longitudinal cross section view of the device 10 of FIG. 1. In a preferred embodiment, the dimensions of the members 11 and 12 are suitable for use with a swimmer's body. Specifically, the lower member 11 is sufficiently wide to simultaneously straddle the legs and crotch of the swimmer, and the connection of the member 11 with the vertical part of the T (e.g. member 12) is an important strength of the present invention.

Figure 8:
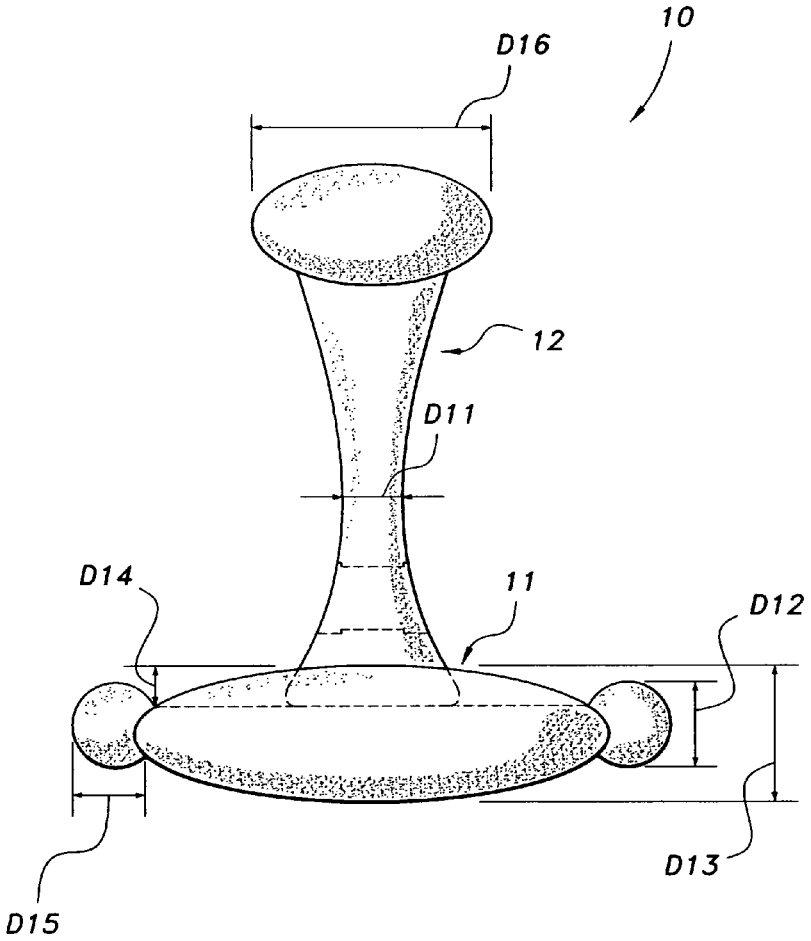
FIG. 8 is a front elevational view of the invention of FIG. 1.
Figure 9:
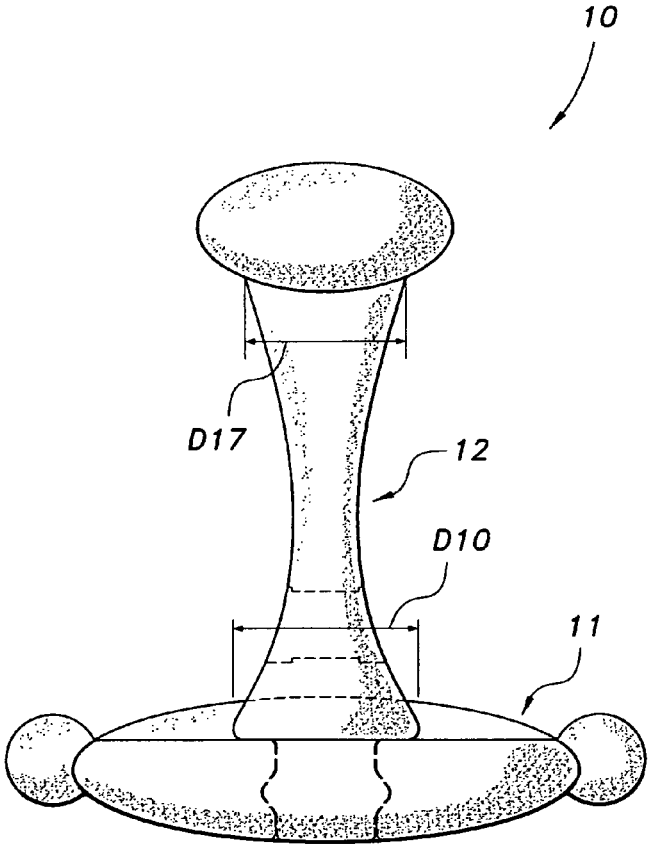
FIG. 9 is a rear elevational view of the invention of FIG. 1.

For illustrative purposes, and to describe the preferred embodiment, dimensions indicated by numerals D1-D20 are shown in FIGS. 7, 8, and 9. These dimensions are provided for purposes of illustration only, and the present invention is not limited to a specific set of dimensions, or to a specific set of relative dimensions. In FIGS. 7-9, the numerals D1-D20 are used to indicate the following specific dimensions in centimeters:

D1=21 cm, D2=5 cm, D3=14 cm, D4=5 cm, D5=3 cm, D6=28 cm, D7=12 cm, D8=3 cm, D9=6.5 cm, D10=36 cm, D11=3 cm, D12=4 cm, D13=6 cm, D14=1.5 cm, D15=3 cm, D16=10 cm, D17=6 cm, D18=8 cm, D19=16 cm, and D20=8 cm.

FIG. 8 is a front elevational view of the device 10 of FIG. 1.

FIG. 9 is a rear elevational view of the device 10 of FIG. 1.

Figure 10:
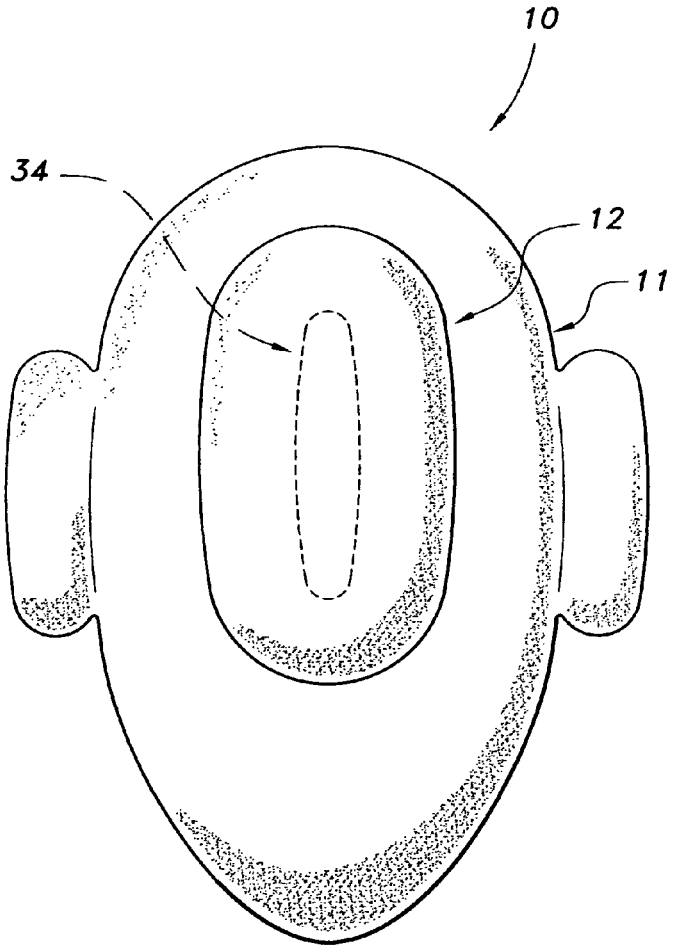
FIG. 10 is a top elevational view of the invention of FIG. 1.

FIG. 10 is a top elevational view of the device 10 of FIG. 1.

Figure 11:
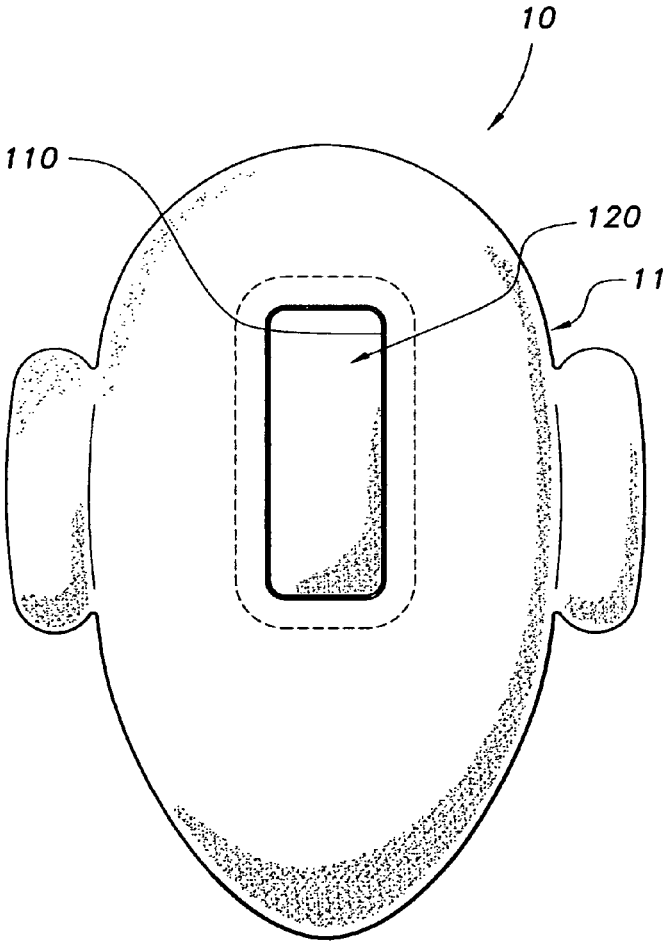
FIG. 11 is a bottom elevational view of the invention of FIG. 1.

FIG. 11 is a bottom elevational view of the device 10 of FIG. 1.

Figure 12:
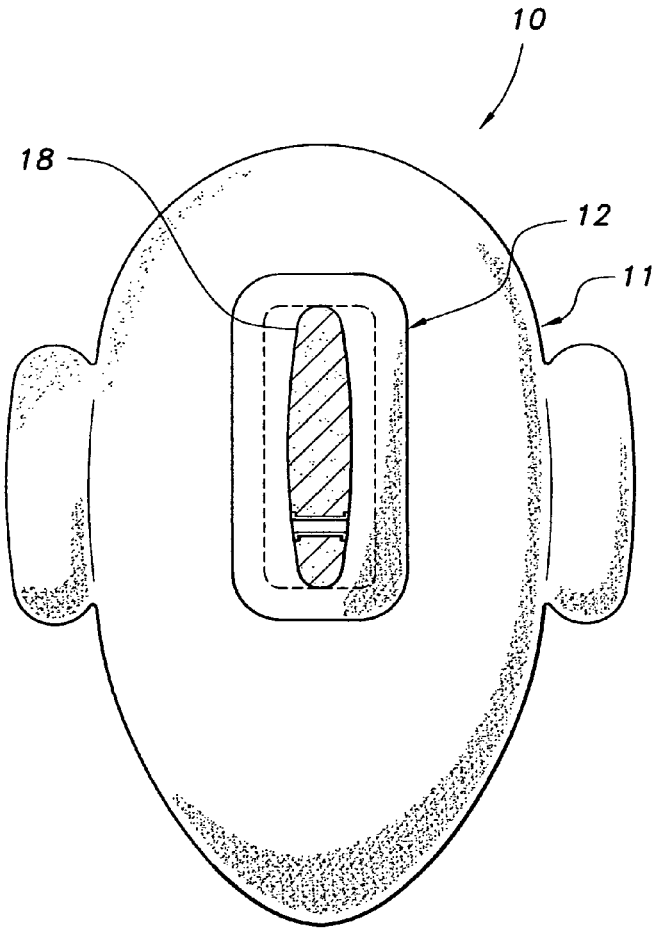
FIG. 12 is a transverse section view through the vertical member of the invention of FIG. 1, as viewed from above.

FIG. 12 is a transverse section view through the vertical member 12 of the device 10 of FIG. 1, as viewed from above.

The invention being thus described, it will be evident that the same may be varied in many ways by a routineer in the applicable arts. Such variations are not to be regarded as a departure from the spirit and scope of the invention and all such modifications are intended to be included within the scope of the claims.

What is claimed is:

1. A swim aid flotation device for supplementing the buoyancy of a swimmer's leg's and body, comprising:

a body adapted for serving as a flotation device, said body having a first portion and a second portion that together form an inverted T shape, said second portion extending from a central region of said first portion and having an enlarged top portion at an end of said second portion distal from said first portion, adapted for engagement and for securement in place with a swimmer's body by positioning of the vertical portion of the T shape with expanded top between the swimmer's legs as well as straddling of the legs by the first portion of the T shape;

a flexible strap attached to said body, said flexible strap being adapted for looping around a waist of the swimmer, such that in use said body serving as a flotation device is additionally held in place against the swimmer's body by the buoyancy of the horizontal and vertical portions of the T shape and enlarged top, thereby lifting the swimmer's lower body region to a more horizontal swimming position during use, whereby attachment of the body serving as a flotation device to the swimmers body enables the swimmer to have free kicking movement of the swimmer's legs and feet during swimming.

2. A swim aid flotation device according to claim 1, wherein said first portion is a horizontal member having generally elliptical, elongated, half oblate shape.

3. A swim aid flotation device according to claim 2, wherein said first portion has an upward sweeping front end that is at an angle which is less than 90 degrees to said second portion.

4. A swim aid flotation device according to claim 2, wherein said first portion has a horizontal shape and width adapted to be sufficiently large and wide enough to straddle the swimmer's legs.

5. A swim aid flotation device according to claim 2, wherein said first portion member has a pair of side portions which are prolate forms adapted for use by the swimmer in holding the body using their hands while said first portion is engaging the surface of the swimmer's legs.

6. A swim aid flotation device according to claim 1, wherein said first portion of said body is connected to said second portion of said body by smoothly curving surfaces.

7. A swim aid flotation device according to claim 6, wherein said body having said T shape with said curving surfaces provides a comfortable engagement with the leg forms and crotch of the swimmer.

8. A swim aid flotation device according to claim 2, wherein said first portion which is said horizontal member is unitary with said vertical portion of said T shape.

9. A swim aid flotation device according to claim 2, wherein said first portion which is said horizontal member is a separate member which is secured by interlocking engagement with said second portion which is said vertical portion of said T shape.

10. A swim aid flotation device according to claim 8, wherein said vertical member has a sufficiently thin cross-section and length to allow the free movement of the legs.

11. A swim aid flotation device according to claim 8, wherein a shank portion of said vertical member has rounded, tapered edges and a generally rectangular cross-section.

12. A swim aid flotation device according to claim 8, wherein said enlarged top portion of said vertical portion of said T shape is has an expanded oblate top having rounded edges.

13. A swim aid flotation device according to claim 1, wherein said body has a slot adapted as an attachment point for securement of said flexible strap.

14. A swim aid flotation device according to claim 1, wherein said flexible strap has a flexible woven body.

15. A swim aid flotation device according to claim 13, wherein said strap loops around and secures the device to the swimmer's body at the waist with a strap locking device allowing the free movement of the legs.

16. A swim aid flotation device according to claim 1, wherein said first portion and said second portion are relatively strong such that they can provide structural stability when in use as a swimming aid.

* * * * *